US007903990B2

(12) United States Patent
Bessho

(10) Patent No.: US 7,903,990 B2
(45) Date of Patent: Mar. 8, 2011

(54) IMAGE FORMING APPARATUS HAVING A CONTROLLER THAT CONTROLS A POTENTIAL

(75) Inventor: Yuji Bessho, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/144,824

(22) Filed: Jun. 24, 2008

(65) Prior Publication Data

US 2009/0016756 A1 Jan. 15, 2009

(30) Foreign Application Priority Data

Jul. 11, 2007 (JP) ..... 2007-182159

(51) Int. Cl.
*G03G 15/06* (2006.01)

(52) U.S. Cl. ..... 399/56; 399/187; 399/198

(58) Field of Classification Search ..... 399/56, 399/187, 198
See application file for complete search history.

(56) References Cited

U.S. PATENT DOCUMENTS 5,153,609 A * 10/1992 Ando et al. ..... 347/129
5,765,089 A * 6/1998 Hasuo et al. ..... 399/366
6,160,979 A 12/2000 Shoji
7,161,712 B2 * 1/2007 Maruta et al. ..... 358/1.9
7,260,347 B2 8/2007 Tamaki et al.

FOREIGN PATENT DOCUMENTS

JP 2000-206794 A 7/2000

* cited by examiner

*Primary Examiner* — David M Gray
*Assistant Examiner* — G. M. Hyder
(74) *Attorney, Agent, or Firm* — Fitzpatrick, Cella, Harper & Scinto

(57) ABSTRACT

In a development device which develops an electrostatic image formed on a rotating photosensitive drum by applying a development bias to a development sleeve bearing a two-component developer, the development device includes a specific pattern determination portion which determines whether or not the electrostatic image includes a specific pattern. When the development device develops the specific pattern electrostatic image determined by the specific pattern determination portion, a potential difference between a development sleeve and a first non-image part of a predetermined range which is adjacent to the specific pattern electrostatic image and located on an upstream side in a photosensitive drum rotating direction is set smaller than a potential difference between the development sleeve and a second non-image part which is different from the first non-image part.

9 Claims, 13 Drawing Sheets

CONVEYING DIRECTION

CONVEYING DIRECTION

IMAGE FORMING APPARATUS HAVING A CONTROLLER THAT CONTROLS A POTENTIAL

BACKGROUND OF THE INVENTION

1. Field of the Invention

The present invention relates to a development device which forms an image by an electrophotographic system, an electrostatic recording system, and the like. Particularly the invention relates to an image forming apparatus which prevents generation of trouble with an information defect, caused by a partially missing specific pattern, such as machine-readable information typified by a barcode and a QR code (registered trademark). The development device generates the partially missing specific pattern.

2. Description of the Related Art

The electrophotographic system is one of well-known printing systems used in a copying machine and a printer. Recently, attention focuses on POD (Print On Demand), and high-speed printing capability and photographic image printing are demanded for the electrophotographic system. Therefore, high-quality and fine print image is also demanded.

Usually, a one-component developer mainly containing non-magnetic toner or magnetic toner or a two-component developer mainly containing the nonmagnetic toner and the magnetic carrier is used in the development device included in the electrophotographic system or electrostatic recording system image forming apparatus. Particularly, in the color image forming apparatus in which a full-color or multi-color image is formed by the electrophotographic system, from the viewpoint of image color, the two-component developer is used in the most development devices. Using the development devices, toner images are superimposed on a sheet or an intermediate transfer member, and the toner is melted and fixed to the sheet to form the color image.

On the other hand, recently documents on which confidential information is listed are strictly managed for the purpose of information security. In the field of image formation, when the document on which confidential information is listed is formed, a mark indicating a confidential document is added to the document on which confidential information is listed in order to clearly recognize that the confidential information is listed on the document. In order not to produce a duplicate, the image forming apparatus interrupts or disables the image formation when the image forming apparatus recognizes the document as confidential document including the confidential information. In order to operate the image forming apparatus in the above-described manner, the added mark or information is formed by easily recognizable mark or so-called machine-readable information. The mark is expressed by characters such as confidence and secret. Examples of the machine-readable information include an encrypted pattern, the barcode, and the QR code.

In the two-component development device, usually a non-image part has a potential difference opposite an image part such that the toner is not developed in the non-image part (that is, such that fog is not generated) (hereinafter referred to as "fog removal potential"). Because the toner has a fixed polarity in the development device, the toner is kept away from the non-image part by the fog removal potential.

In the two-component development device, usually a rotating speed of a developer bearing member is enhanced one to two times a rotating speed of a surface of an image bearing member such that the toner is effectively supplied to the image bearing member.

A toner charging amount depends on temperature and humidity of an environment in which the toner is used or a mixture ratio to a carrier. Usually the toner charging amount is lowered in the high-temperature and high-humidity environment, and the toner charging amount is increased in the low-humidity environment.

However, in forming the barcode or QR code image which is of the machine-readable information, sometimes the image defect causes the development device to generate the missing information.

When the partially missing machine-readable information is generated, there is a possibility that the information cannot be reproduced by the machine reading, and the missing information is made worse. Frequently the machine-readable information typified by the barcode and the QR code is used as a security code. However, when the image defect is generated, the machine-readable information does not function as the security code. Even in the QR code used to prevent duplication, the QR code is not recognized as the machine-readable information due to the image defect, which possibly generates a problem in that duplication is enabled.

Therefore, for example, Japanese Patent Application Laid-Open No. 2000-206794 discloses a device which reduces a toner scrabble phenomenon in order to suppress the generation of the image defect according to a developer concentration and a beam diameter.

The information missing phenomenon caused by the image defect is remarkably generated in the case of the low toner charging amount. In the case of the low toner charging amount, because an electrostatic adsorption force with the image bearing member is decreased, the toner is easily separated from the image bearing member, which causes the image defect.

Furthermore, the information missing phenomenon is remarkably generated in the case of the thin (latent image having a small potential change) electrostatic image (hereinafter referred to as "electrostatic latent image" or simply referred to as "latent image") such as a narrow line and half tone. Usually laser power is controlled such that the toner amount developed to the latent image generated by an integrated light quantity in forming the solid latent image becomes a predetermined density. However, in reproducing the narrow line, sometimes the integrated light quantity becomes small for the solid latent image, and the potential changes of the narrow-line latent image part and other parts are small in comparison with the potential change of the solid latent image.

In the case where a later-mentioned pulse width modulation circuit is used, it is necessary to shorten a pulse width in order to reproduce a line width of the narrow line. Therefore, even if the laser is driven with the pulse width for reproducing the narrow line, the laser power rises insufficiently, and the narrow-line latent image is formed with insufficient laser power, whereby the latent image becomes thin. In the half-tone latent image, the latent image tends to become thin due to the similar reason. Accordingly, the image defect is easily generated because the electrostatic adsorption force between the toner and the image bearing member is weakened for the thin latent image.

The phenomenon will specifically be described with reference to the drawings. FIG. 11 illustrates the state in which the image defect is generated. A part of a developer bearing member (development sleeve) SL is illustrated on the left side of FIG. 11, a part of an image bearing member (photosensitive drum) Dr is illustrated on the right side of FIG. 11, and the carrier and toner of the two-component developer are illustrated in an area between the development sleeve SL and the photosensitive drum Dr. A drum surface potential (Vd) at a solid white part, a drum surface potential (V1) at a solid part, and magnitude of a development potential (Vdc) applied to the development sleeve SL are expressed in (r, ϕ) axis while correlated with a position of the drum surface.

Referring to FIG. 11, in the solid white part, for the drum surface potential surrounded by a broke line, a force is applied to the toner by a potential difference with the development potential Vdc such that the toner is pressed toward a development sleeve direction. The drum surface potential acts as a so-called fog removal potential (Vback) which keeps the toner away from the solid white part. On the contrary, a force is applied to the carrier having the polarity opposite to the toner such that the carrier is pressed toward the photosensitive drum direction.

Accordingly, in the part surrounded by the broken line, because the toner is pressed against the development sleeve SL by the fog removal potential, the amount is increased near the development sleeve, and the carrier amount is increased near the photosensitive drum while the toner amount is decreased. In the narrow-line latent image part, because the toner is developed for the photosensitive drum, the toner amount is schematically increased only in the narrow-line part.

Near the photosensitive drum of the part surrounded by the broken line, the many carriers whose surfaces are exposed exist because the toner amount is decreased. Accordingly, because the carrier whose surface is exposed generates a charge having the polarity opposite to the toner (so-called countercharge), the carrier easily generates an effect (scavenging phenomenon by countercharge) of peeling off the toner developed on the photosensitive drum. Particularly, in the case where a high-resistance carrier is used, the scavenging phenomenon tends to become prominent because a charge attenuation time is required.

In order to efficiently supply the toner from the development sleeve, the rotating speed of the development sleeve is set 1.5 times the rotating speed of the photosensitive drum. In the case of FIG. 11, the carriers in the countercharge state perform the scavenging to the narrow line on the photosensitive drum to peel off a part of the toner image. The problem is described only by way of example because the scavenging becomes prominent when a circumferential speed of the development sleeve is higher than a circumferential speed of the photosensitive drum. Additionally, the similar problem is possibly generated even if the circumferential speed of the development sleeve is equal to the circumferential speed of the photosensitive drum. That is, in the non-image part adjacent to the toner image, the toner image is possibly disturbed by receiving the electric force from the carrier.

FIG. 12 schematically illustrates the state in which the scavenging is generated in the narrow-line toner image. FIG. 12A illustrates the ideal toner image state in which the scavenging is not generated. FIG. 12B illustrates the state in which a part on the upstream side in the rotating direction (latent image conveying direction) of the photosensitive drum, that is, a rear end part of the narrow line is scrabbled by the scavenging (hereinafter referred to as "rear-end scrabble").

Not only the rear-end scrabble phenomenon becomes a trouble in visualizing the latent image, but also the rear-end scrabble phenomenon leads to the information missing in reproducing the machine-readable information such as the barcode. FIGS. 13A to 13D schematically illustrate the states of the machine-readable information when the rear-end scrabble is generated. FIG. 13A illustrates the barcode, FIG. 13C illustrates the QR code, and FIGS. 13B and 13D illustrate the states in which the rear-end scrabble partially scrabbles the machine-readable information to generate the information missing.

In recording the machine-readable information, it is necessary to prevent the generation of the rear-end scrabble phenomenon. Particularly, a configuration in which the rear-end scrabble phenomenon is effectively suppressed is demanded when a Tribo-charge is lowered in the toner.

SUMMARY OF THE INVENTION

The present invention provides an image forming apparatus which can prevent the image defect to surely develop the specific pattern image such as the machine-readable information.

In accordance to a first aspect of the invention, an image forming apparatus includes a rotatable image bearing member; a charging device which charges the image bearing member; an electrostatic image forming device which forms an electrostatic image by exposing the image bearing member, the image bearing member being charged by the charging device; a development device which includes a developer bearing member to develop the electrostatic image in a form of a toner image, the developer bearing member bearing a developer containing toner and a magnetic carrier; and a controller which performs control such that a potential difference between a first non-image part of a predetermined range and the developer bearing member is smaller than a potential difference between a second non-image part and the developer bearing member when an image having a specific pattern is formed, the first non-image part and the second non-image part being included in a non-image part on the image bearing member, the first non-image part being different from the second non-image part, the first non-image part of the predetermined range being adjacent to an electrostatic image having the specific pattern on an upstream side in a rotating direction of the image bearing member.

In accordance to a second aspect of the invention, an image forming apparatus includes a rotatable image bearing member; a charging device which charges the image bearing member; an electrostatic image forming device which forms an electrostatic image by exposing the image bearing member, the image bearing member being charged by the charging device; a development device which includes a developer bearing member to develop the electrostatic image in a form of a toner image, the developer bearing member bearing a developer containing toner and a magnetic carrier; and a controller which performs control such that a potential difference between a non-image part of a predetermined range and the developer bearing member is smaller than a potential difference between other non-image parts and the developer bearing member when an image having a specific pattern is formed, the non-image part of the predetermined range being adjacent to an electrostatic image having the specific pattern on an upstream side in a rotating direction of the image bearing member.

Further features of the present invention will become apparent from the following description of exemplary embodiments (with reference to the attached drawings).

DESCRIPTION OF THE EMBODIMENTS

An image forming apparatus according to an exemplary embodiment of the invention will be described below with reference to the drawings.

First Embodiment

Entire Configuration of Image Forming Apparatus

Figure 1:
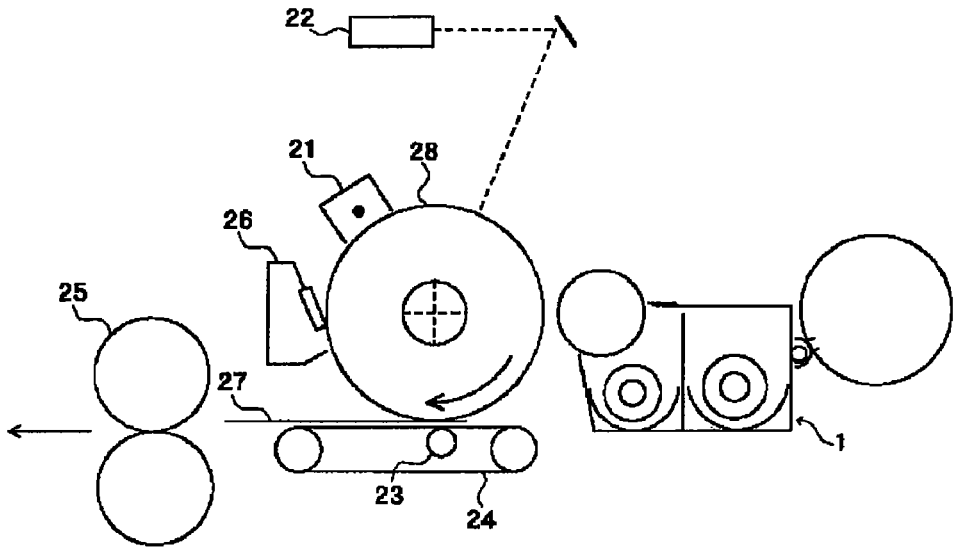
FIG. 1 is an explanatory view illustrating a schematic configuration of an image forming apparatus according to a first embodiment of the invention.

An entire configuration and an image forming operation of an image forming apparatus according to a first embodiment of the invention will schematically be described with reference to FIG. 1. FIG. 1 is an explanatory view illustrating the schematic configuration of the image forming apparatus of the first embodiment.

Around a photosensitive drum (image bearing member) 28 which can be rotated in an arrow direction of FIG. 1, a charging device 21, an exposure unit (electrostatic image forming device) 22, a development device 1, and a cleaner 26 are sequentially disposed in a rotating direction of the photosensitive drum 28. In the image formation, the charging device 21 negatively charges a surface of the rotating photosensitive drum 28, and the exposure unit 22 illuminates the surface of the rotating photosensitive drum 28 to form an electrostatic latent image on the basis of a color image signal. The development device 1 develops the latent image to obtain a visible image using negative toner.

On the other hand, using a conveying belt 24, a sheet feeding unit (not illustrated) conveys a recording material 27 to an image transfer portion in synchronization with the image forming operation. In the image transfer portion, a transfer bias is applied to a transfer roller 23 to transfer the toner image formed on the photosensitive drum 28 to the recording material 27. Then, the recording material 27 to which the toner image is transferred is conveyed to a fixing device 25, and the fixing device 25 pressurizes and heats the recording material 27 to form a permanent image on the recording material 27. In order to prepare the next image formation, the cleaner 26 removes the residual toner remaining on the photosensitive drum 28 after the toner image is transferred.

The plural image forming portions (stations) having the above-described configurations are disposed to form cyan (C), magenta (M), yellow (Y), and black (K) images, and the images are superimposed to form a color image.

(Development Device)

Figure 2:
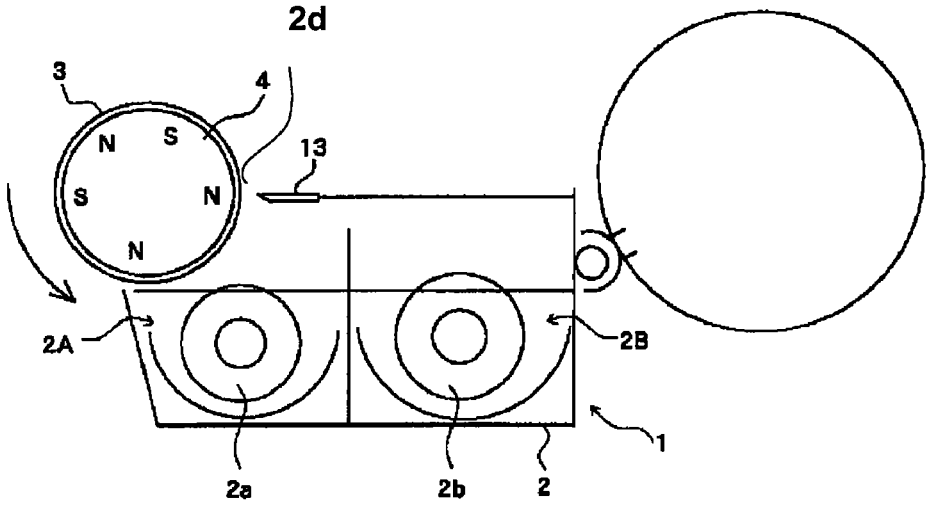
FIG. 2 is a sectional view schematically illustrating a development device.
Figure 3:
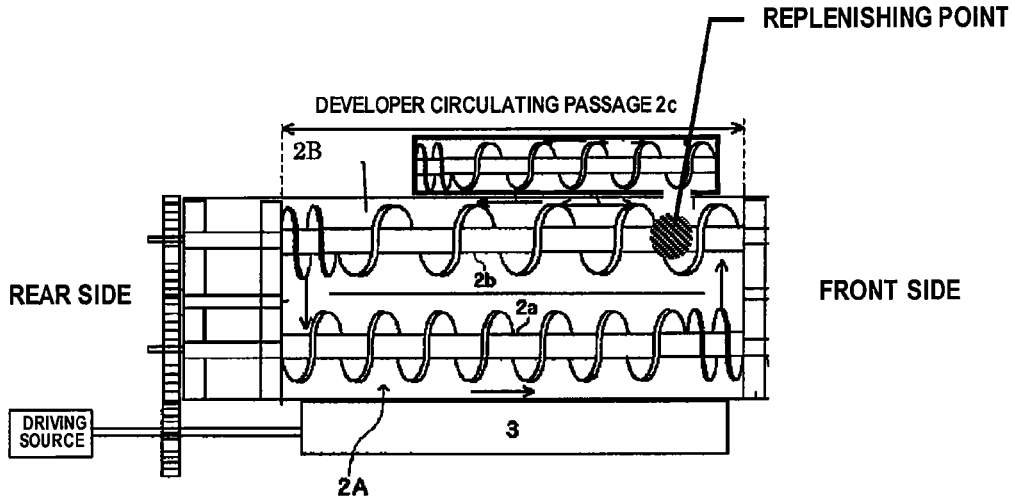
FIG. 3 is a top view illustrating the development device.

The development device 1 will be described with reference to FIGS. 2 and 3. FIG. 2 is a sectional view schematically illustrating the development device 1, and FIG. 3 is a top view illustrating the development device 1.

A two-component developer including non-magnetic toner and a magnetic carrier is stored in the development device 1 of the first embodiment, and the developer has a toner concentration of 7% in an initial state. A value of the toner concentration should properly be adjusted according to the toner charging amount, a carrier particle diameter, and the configuration of the image forming apparatus. The invention is not limited to the value of the toner concentration.

As illustrated in FIG. 2, in the development device 1, a development sleeve 3 which is of a developer bearing member is rotatably disposed so as to be partially exposed to an opening 2*d* formed at a position facing the photosensitive drum 28. In the first embodiment, a circumferential speed of the development sleeve is set to 1.5 times a circumferential speed of the facing photosensitive drum. The development sleeve 3 which conveys the developer to the photosensitive drum 28 includes a fixed magnet 4 which is of a magnetic field generating unit. The development sleeve 3 is made of a non-magnetic material, and the development sleeve 3 is rotated in an arrow direction of FIG. 2 during development operation. A doctor blade 13 made of a magnetic material is disposed with a predetermined gap with the development sleeve 3.

In the fixed magnet 4 of the development sleeve 3, one of adjacent magnetic poles having the same polarity is set to a developer layer thickness regulating pole which regulates a developer layer thickness. The development sleeve 3 bears and conveys the two-component developer in the two-component developer to a development area while a doctor blade 13 retains the two-component developer in a laminated manner. The development sleeve 3 supplies the two-component developer to the development area facing the photosensitive drum 28, thereby developing the electrostatic latent image formed on the photosensitive drum 28. After the electrostatic latent image is developed, the developer is conveyed according to the rotation of the development sleeve 3, and the developer is recovered in the development container 2 which is of a developer storage portion.

On the other hand, the development container 2 includes a developer storage chamber (hereinafter referred to as "development chamber") 2A and a developer storage chamber (hereinafter referred to as "stirring chamber") 2B. The development container 2 is partitioned along the development sleeve 3 into the development chamber 2A and the stirring chamber 2B. The development chamber 2A which is of a first chamber is located close to the development sleeve 3, and the stirring chamber 2B which is of a second chamber is located away from the development sleeve 3. The development chamber 2A includes a first developer circulating screw 2*a*, and the stirring chamber 2B includes a second developer circulating screw 2*b*. The developer in the development container 2 is circulated through a developer circulating passage 2*c* of FIG. 3 and mixed and stirred by the developer circulating screws 2*a* and 2*b*.

In the first embodiment, as illustrated in FIG. 3, the developer circulating direction is a direction from a front side toward a rear side on the side of the stirring chamber 2B, and the developer circulating direction is a direction the rear side toward the front side on the side of the development chamber 2A.

Figure 4:
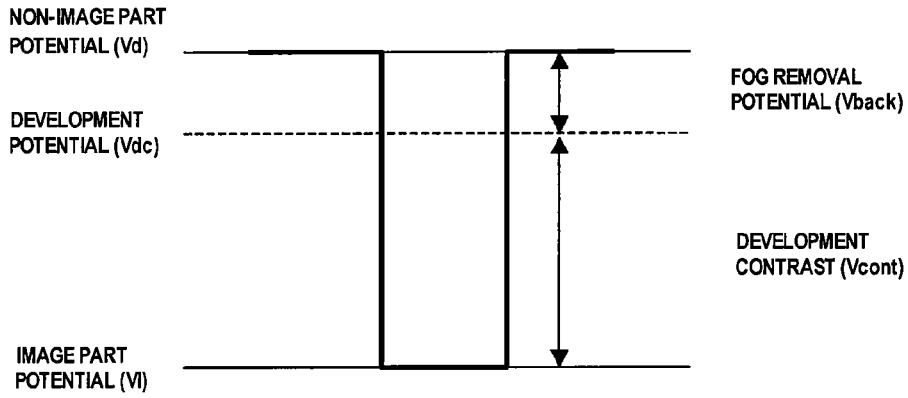
FIG. 4 is an explanatory view illustrating potentials at an image part and a non-image part of a photosensitive drum and a bias applied to a development sleeve.

FIG. 4 illustrates a relationship between potentials at an image part and a non-image part of the photosensitive drum and a bias applied to the development sleeve in the first embodiment.

In the first embodiment, the toner image is visualized by developing the negative toner to an exposure part on the negatively-charged photosensitive drum. FIG. 4 schematically illustrates the potentials at the image part and non-image part on the photosensitive drum and an absolute DC value of a development bias applied to the development sleeve.

Because the toner has the evenly-negative polarity, a fog removal potential (Vback) is applied to the toner in the non-image part, and the force in the development sleeve direction is applied to the toner. Accordingly, because the force separating the toner from the photosensitive drum is applied to the toner, the toner adhesion (so-called fog) is hardly generated in the non-image part. On the other hand, in the image part, the development operation is performed while a force pressing the toner against the photosensitive drum is applied to the toner by a development contrast potential (Vcont). In the first embodiment, the fog removal potential Vback is set to 150V, and the development contrast potential is set to 250V.

(Fog Removal Potential at Scrabble Preventing Latent Image Part)

In printing a specific pattern image of the machine-readable information such as the barcode or the QR code which is used to read imaging information, because the missing of information is generated when the rear-end scrabble phenomenon is generated, it is necessary to prevent the rear-end scrabble phenomenon. As described above, the thin latent image can be cited as an example of the specific pattern latent image in which the rear-end scrabble phenomenon is easily generated. As used herein, the thin latent image shall mean that the integrated light quantity becomes decreased for the solid latent image. For example, the thin latent image means that the potential changes of the narrow-line latent image part and other parts are smaller than that of the solid latent image. The thin latent image depends on a spot diameter of a laser beam and a formed line width. In an isolated dot or a set of several dots, the potential change is possibly smaller than that of the solid latent image, and the scrabble phenomenon is easily generated. In the embodiment, the machine-readable information shall mean coded image information such as the barcode and the QR code, and the machine-readable information shall mean information in which specific information is recognized by reading the information with the machine.

In the embodiment, because the laser beam has the spot diameter of 45 μm in both the main scanning direction and the sub-scanning direction, the latent image becomes thin and the potential change is small in the narrow line having the width of about 100 μm or less or the dot having the diameter of about 100 μm or less.

In the first embodiment, the image can surely be reproduced while the missing of the specific pattern image such as the machine-readable information, caused by the rear-end scrabble, is prevented during the development. Therefore, in the first embodiment, in forming the machine-readable information as the specific pattern image, control is performed to solve the problem such that the potential difference Vback between the development sleeve and the non-image part of the predetermined range is smaller than a potential difference between the development sleeve and the non-image part except for the predetermined range. The non-image part of the predetermined range is adjacent to the specific pattern electrostatic image, and the non-image part of the predetermined range is located on the upstream side in the photosensitive drum rotating direction which is of the image bearing member rotating direction. The non-image part except for the predetermined range shall include an area (imagable area) corresponding to a recording material conveying area and a non-image part where the image is not formed in at least the image bearing member surface.

Figure 5:
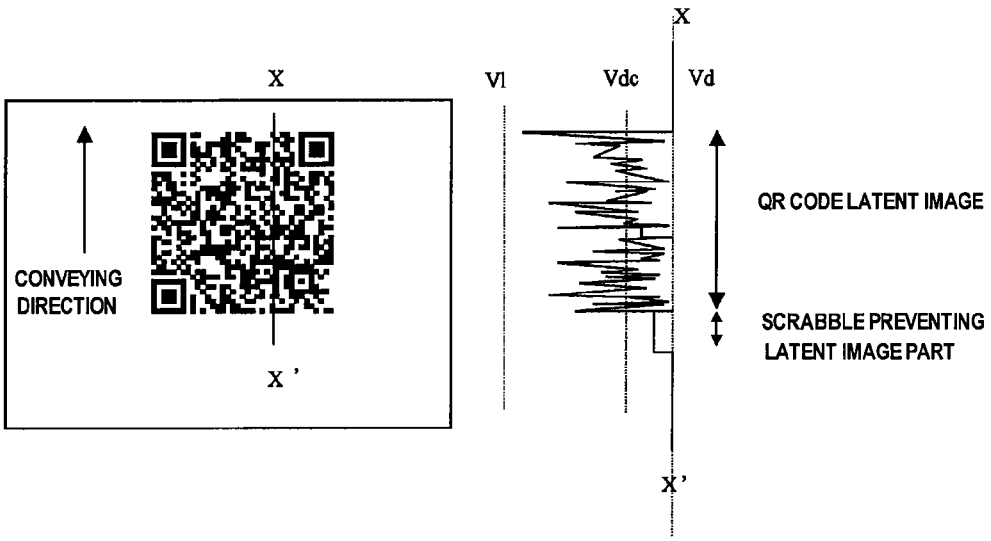
FIG. 5 is an explanatory view illustrating a state of a photosensitive drum potential when a QA code is recorded by the development device.

FIG. 5 is an explanatory view illustrating the state of the photosensitive drum potential when the QA code which is of the machine-readable information is recorded by the development device.

In the first embodiment, in developing the image of a line X-X' of the QR code transferred to the recording material, the generation of the rear-end scrabble is prevented using the photosensitive drum potential illustrated on the right side of FIG. 5.

The potential illustrated on the right side of FIG. 5 schematically illustrates the potentials at the image part and non-image part on the photosensitive drum and the absolute DC value of the development bias applied to the development sleeve. In FIG. 5, the potential is expressed so as to be increased toward the right.

The potential illustrated on the right side of FIG. 5 illustrates the state of the photosensitive drum potential in the line X-X'. Therefore, the exposure potential at the line image of the QR code to be developed with the toner is brought close to a drum surface potential V1 of the solid part.

In the first embodiment, the non-image part on the upstream side in the conveying direction (drum rotating direction) of the photosensitive drum for forming the QR code is slightly set smaller. Referring to FIG. 5, compared with other non-image parts, only the potential at the scrabble preventing latent image part is changed toward the development potential Vdc to set the fog removal potential Vback smaller. That is, the control is performed such that the potential difference between the development sleeve and the scrabble preventing latent image part in the non-image part is smaller than the potential difference between the development sleeve and the non-image part except for the scrabble preventing latent image part.

At this point, a first non-image potential which is of the fog removal potential at the scrabble preventing latent image part is referred to as "scrabble preventing potential Vback", and a second non-image potential which is of the fog removal potential at the non-image part except for the scrabble preventing latent image part is referred to as "center potential Vback". In the first embodiment, the scrabble preventing potential Vback is set to 130V, the center potential Vback is set to 150V, and the scrabble preventing potential Vback is set as small as 20V.

Figure 6:
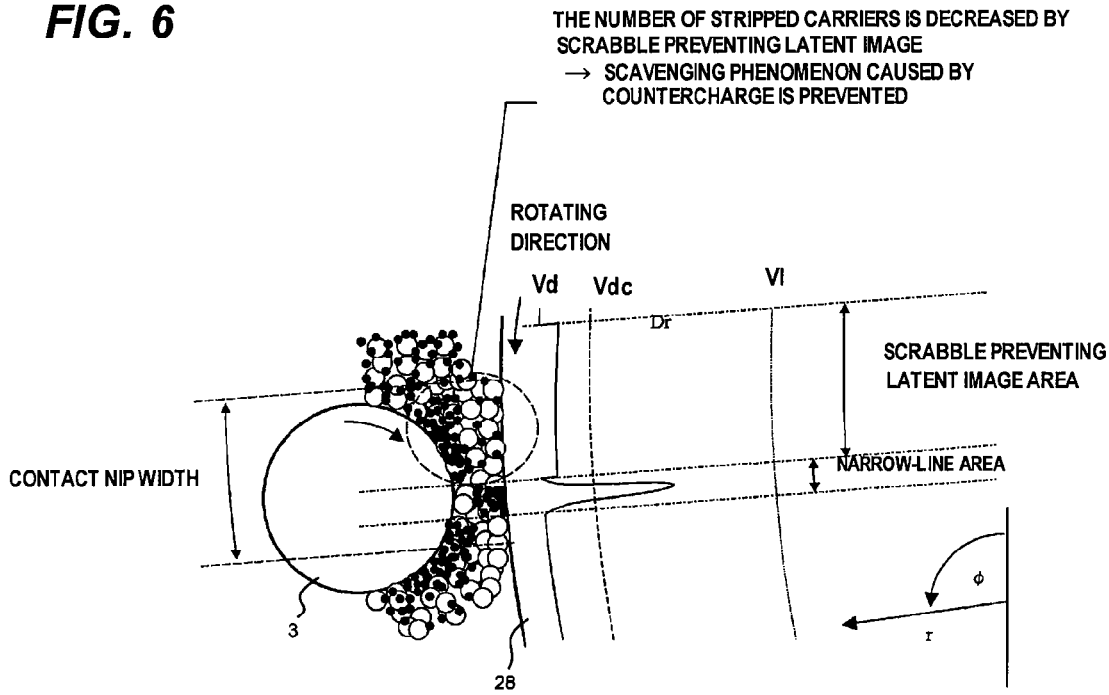
FIG. 6 is an explanatory view illustrating a fog removal potential at a scrabble preventing latent image portion.

The scrabble preventing potential Vback will be described with reference to FIG. 6. As illustrated in FIG. 6, in the fog removal preventing latent image area to which the fog removal potential is applied, the toner in the developer on the development sleeve 3 is pressed against the development sleeve 3. Therefore, the carrier is stripped out near the drum surface.

Figure 11:
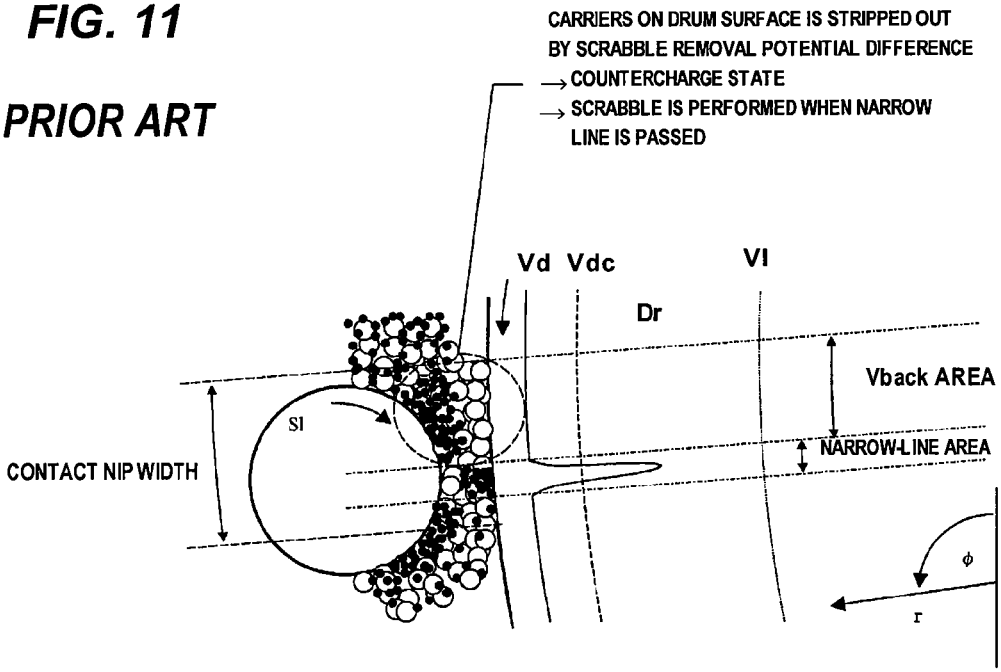
FIG. 11 PRIOR ART
FIG. 11 is an explanatory view illustrating a conventional fog removal potential.
Figure 12A:
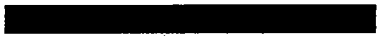
FIG. 12A PRIOR ART
FIG. 12 is an explanatory view illustrating a rear-end scrabble phenomenon.
Figure 12B:
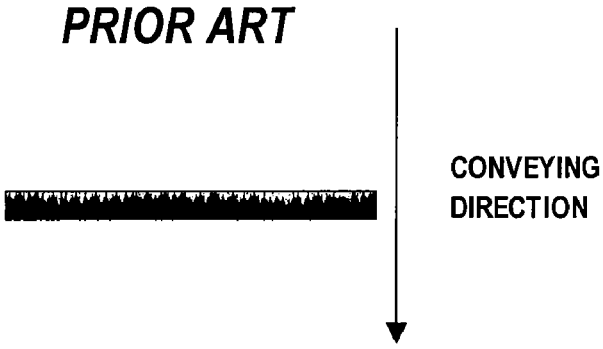
FIG. 12B PRIOR ART

However, as illustrated in FIG. 6, in the first embodiment, the scrabble preventing potential Vback is set smaller than the center potential Vback which is of the fog removal potential at other non-image parts. Therefore, a degree at which the carrier is tripped out is decreased compared with the case in which the constant fog removal potential is applied to the non-image part (see FIG. 11).

Specifically, in the developer on the development sleeve corresponding to the fog removal preventing latent image part, the degree at which the carrier is tripped out near the drum surface becomes smaller than that of the center potential Vback. This is attributed to the fact that the carrier is hardly stripped out in the developer near the drum surface because the scrabble preventing potential Vback is set smaller to weaken the force pressing the toner against the development sleeve.

Accordingly, in the first embodiment, the generation of the countercharge caused by the stripped carrier is suppressed by setting the scrabble preventing potential Vback smaller than the center potential Vback, so that the generation of the scavenging phenomenon, that is, the generation of the rear-end scrabble caused by the countercharge can be prevented.

The scrabble preventing potential Vback is produced by slightly exposing the non-image part of the predetermined range to lower the drum potential. In FIG. 5, the non-image part of the predetermined range is adjacent to the QR code and located on the upstream side in the photosensitive drum rotating direction. In the first embodiment, there is adopted a so-called pulse width modulation circuit (not illustrated) in which a laser driving pulse having a width (temporal length) corresponding to a level of a fed pixel image signal is formed and supplied in each pixel image signal. In a usual image output, the pixel image signal is converted into a pixel image signal having an output level corresponding to each pixel density, and the pixel image signal is supplied to a pulse width modulation circuit (not illustrated).

Figure 7:
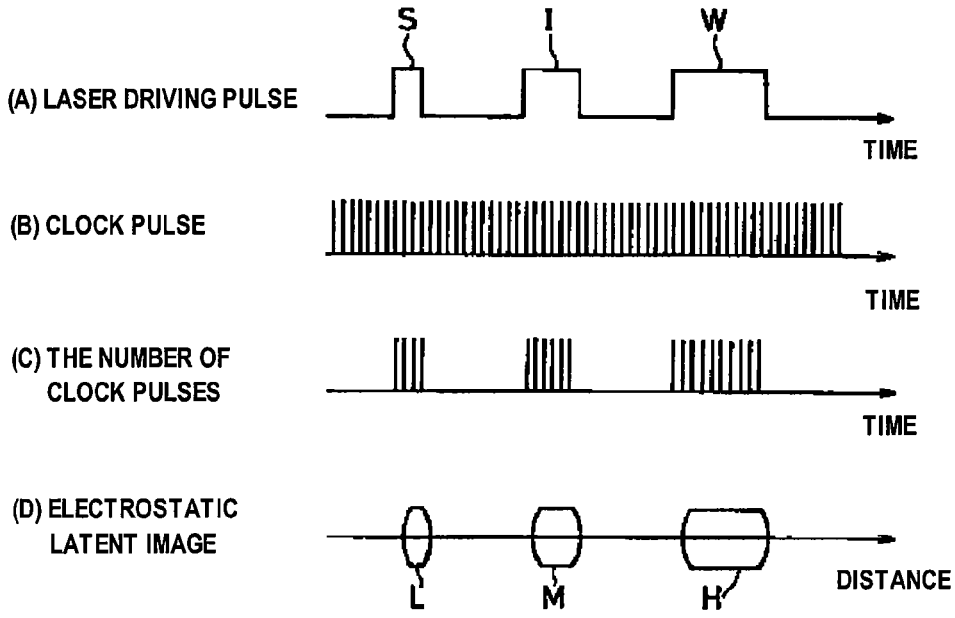
FIG. 7 is an explanatory view illustrating a latent image forming pulse.

The pulse width modulation circuit forms and supplies the laser driving pulse having the width (temporal length) corresponding to the level of the fed pixel image signal. That is, as illustrated in FIG. 7A, a wider driving pulse W is formed for the high-density pixel image signal, a narrower driving pulse S is formed for the low-density pixel image signal, and a driving pulse I having a medium width is formed for a medium-density pixel image signal.

The laser driving pulse supplied from the pulse width modulation circuit is supplied to the semiconductor laser, and the semiconductor laser emits light for a time corresponding to the pulse width. Accordingly, the semiconductor laser is driven for a longer time for the high-density pixel, and the semiconductor laser is driven for a shorter time for the low-density pixel. In the photosensitive drum, the longer range is exposed in the main scanning direction for the high-density pixel, and the shorter range is exposed in the main scanning direction for the low-density pixel. That is, a dot size of the electrostatic latent image depends on the pixel density. Obviously the high-density pixel is larger than the low-density pixel in an amount of toner consumption. In FIG. 7D, the letters L, M, and H designate the electrostatic latent images of the low-density pixel, medium-density pixel, and high-density pixel. In the first embodiment, the driving time used to reproduce the low density of FIG. 7D is used in forming the scrabble preventing potential Vback.

(Range of Scrabble Preventing Latent Image Part)

As described above, the range where the scrabble preventing potential Vback is applied to form the scrabble preventing latent image part is the non-image part which is adjacent to the electrostatic image of the machine-readable information and located on the upstream side in the photosensitive drum rotating direction. The range will be described below.

The range of the scrabble preventing latent image part in the main scanning direction (rotating shaft direction of the photosensitive drum) is equal to the width of the machine-readable information such as the QR code and the barcode. The range in the sub-scanning direction (photosensitive drum rotating direction) is substantially equal to a contact nip width illustrated in FIG. 6. As used herein, the contact nip width shall mean a part in which the developer and the photosensitive drum directly contact each other during the development operation. In the first embodiment, the contact nip width is set to 4 mm. The sizes of the scrabble preventing latent image parting the sub-scanning direction and the main scanning direction are not limited to the first embodiment, but the sizes may be set smaller as long as the effect is obtained.

Figure 8:
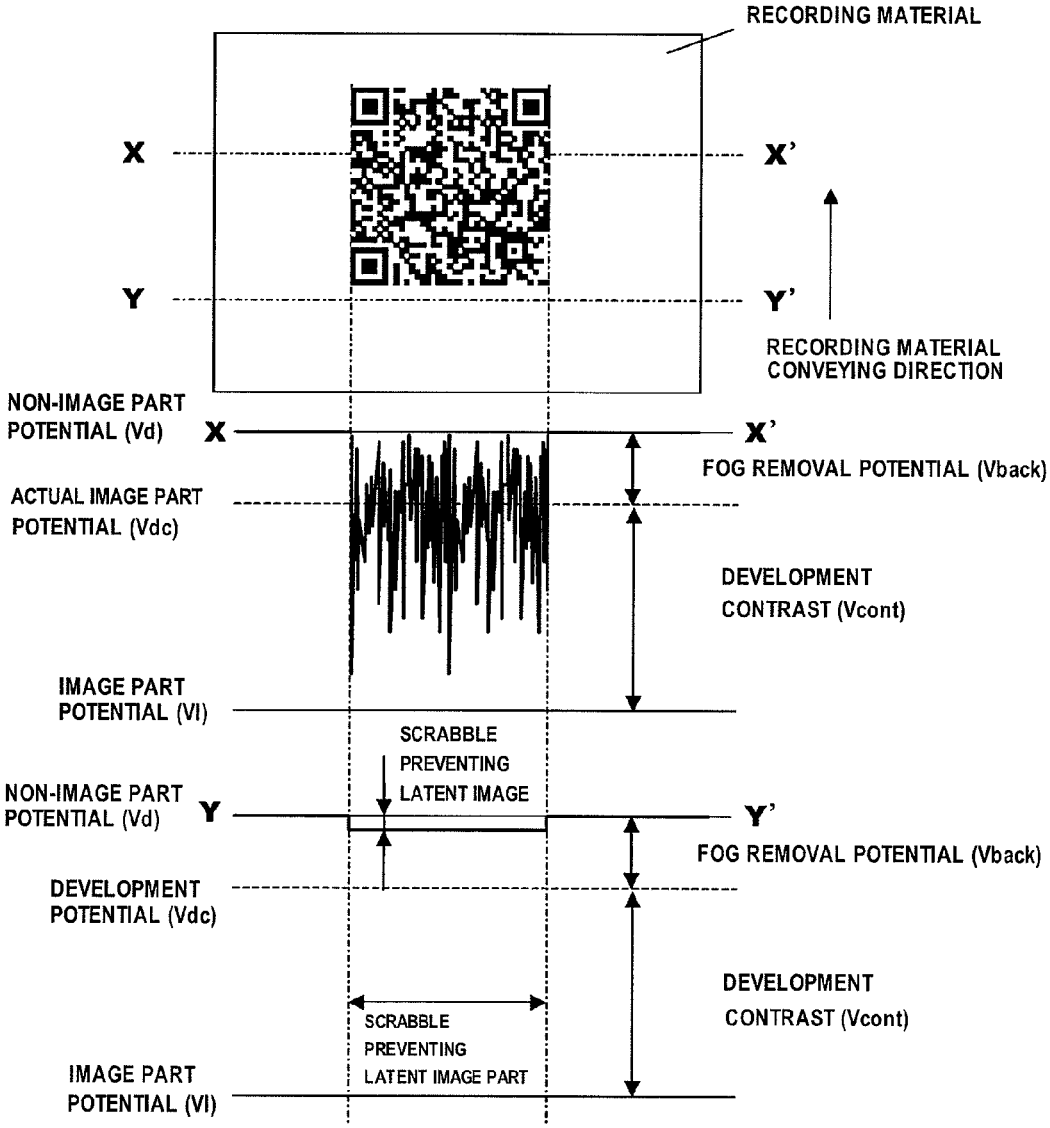
FIG. 8 is an explanatory view schematically illustrating a correlation with a photosensitive drum potential when the QR code is printed in the recording material.

FIG. 8 is an explanatory view schematically illustrating a correlation with the photosensitive drum potential when the QR code is printed in the recording material. In printing the QR code located on a line X-X' on the recording material, the photosensitive drum potential and the photosensitive drum potential at the scrabble preventing latent image part located on the line Y-Y' on the recording material are illustrated below the recording material.

The latent image potential exists in the drum potential corresponding to the line X-X' in order to form the QR code. On the other hand, the width in the main scanning direction is set equal to the width of the QR code in the drum potential corresponding to the line Y-Y', and the drum potential is set lower than those of other solid white parts (non-image parts) by the voltage of 20V as the scrabble preventing latent image.

The fog removal potential Vback is not locally lowered unlike the first embodiment, but the fog removal potential Vback may wholly be lowered to prevent the generation of the scrabble phenomenon. However, undesirably a background fog phenomenon is easily generated in the whole image, when the fog removal potential Vback is wholly lowered. When the scrabble preventing potential Vback is set lower than the center potential Vback, the fog removal potential is lowered only in the scrabble preventing latent image part. Therefore, a risk of generating the fog is increased only in the scrabble preventing latent image part. However, because of the local fog, the fog is not prominent, and the fog hardly becomes troublesome. Because the scrabble phenomenon is generated when the developer which receives the fog removal potential on the upstream side of the contact nip becomes the countercharge state, the scrabble phenomenon is generated only when the solid white part exists to a certain extent.

Figure 13A:
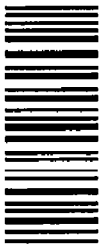
FIG. 13A PRIOR ART
FIG. 13 is an explanatory view illustrating the rear-end scrabble phenomenon in machine-readable information.
Figure 13B:
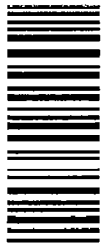
FIG. 13B PRIOR ART
Figure 13C:
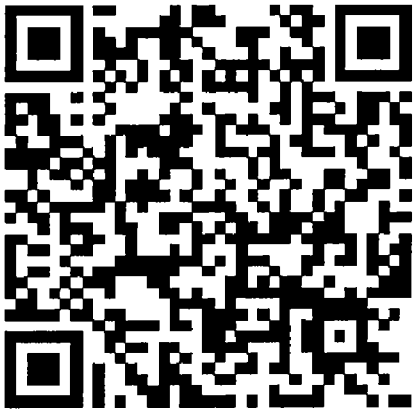
FIG. 13C PRIOR ART
Figure 13D:
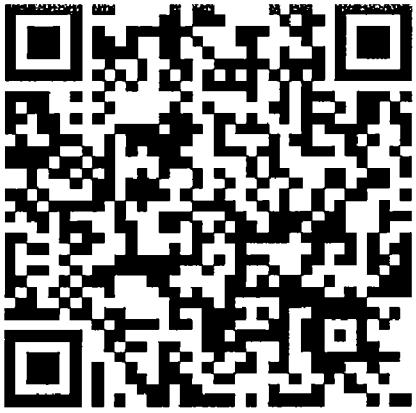
FIG. 13D PRIOR ART

Because the local solid white part (for example, a gap between the lines of the barcode of FIG. 13A and the solid white part in the QR code of FIG. 13C) forms an average potential along with the adjacent line part potential, the developer hardly becomes the countercharge state. Therefore, the local solid white part does not cause the scrabble phenomenon.

(Recording Control of Machine-Readable Information)

Figure 9:
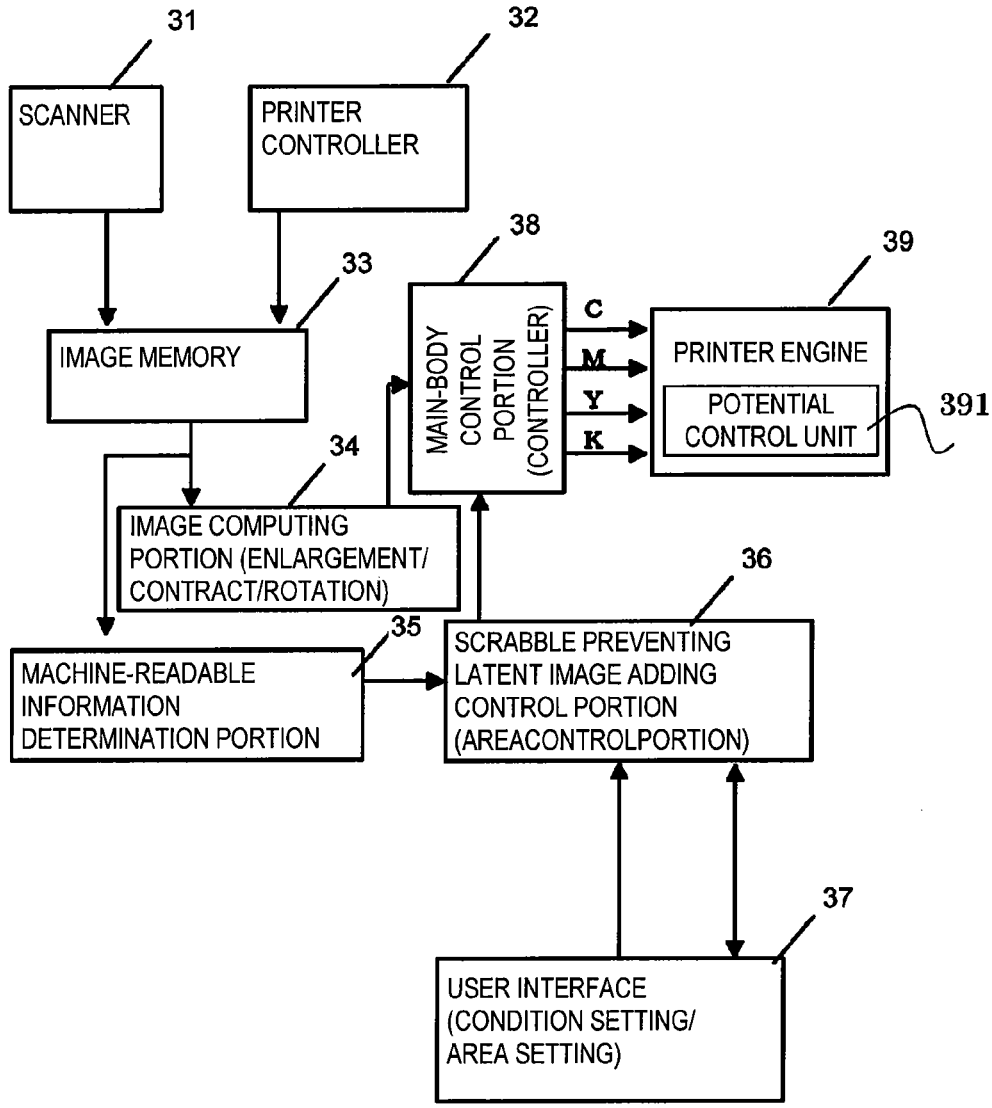
FIG. 9 is a block diagram illustrating a control configuration of a color copying machine which is of the image forming apparatus.

A recording control configuration of the machine-readable information such as the barcode and the QR code will be described with reference to FIG. 9. FIG. 9 is a block diagram illustrating a control configuration of the color copying machine which is of the image forming apparatus of the first embodiment.

Referring to FIG. 9, the color copying machine includes a scanner 31, a printer controller 32, and an image memory 33. The scanner 31 and the printer controller 32 feeds color image information and image control information into the image memory 33. The color copying machine also includes an image computing portion 34 into which the color image information is fed from the image memory 33, a machine-readable information determination portion 35 which is of a specific pattern determination portion, a scrabble preventing latent image adding control portion 36, and a machine-readable information converting portion. The color copying machine also includes a user interface 37, a controller 38, and a printer engine 39. The image data scanned by the scanner 31 is finally printed to obtain the duplicate image by the printer engine 39. The printer engine 39 includes a potential control unit 391 which controls the potential at the image bearing member based on a signal from the controller 38.

The scanner 31 scans an original placed on a contact glass, the scanner takes in the light reflected from the original, and the scanner supplies the cyan (C), magenta (M), yellow (Y), and black (K) pieces of image data to the image memory 33. The image data is tentatively stored in the image memory 33. The printer controller 32 is provided in the copying machine main body. The printer controller 32 controls the whole of copying machine, and the printer controller 32 performs the control necessary for the print according to a user input from an operation display portion (not illustrated) through the user interface 37. The printer controller 32 feeds a controls signal into the image memory 33.

The image computing portion 34 performs image processing such as enlargement, contraction, and rotation to the image data stored in the image memory 33 according to an instruction from the printer controller 32, and the image computing portion 34 supplies the image data to the controller 38. The same data as the data supplied from the image memory 33 to the color image computing portion 34 is fed into the machine-readable information determination portion 35, and the machine-readable information determination portion 35 determines whether or not the fed data is the machine-readable information.

Area specifying information for specifying an area printed as the machine-readable information is fed into the scrabble preventing latent image adding control portion 36 from the machine-readable information determination portion 35. An area where the machine-readable information is printed is fed as previously specified area information into the scrabble preventing latent image adding control portion 36 from the user interface 37.

The instructions such as a condition setting and an area setting are fed into the user interface 37 through the operation display portion (not illustrated) by a user, and the input state, information necessary for the operation transmitted from the image forming apparatus side, and input information are displayed on the user interface 37.

Signals are fed into the main-body control portion (controller) 38 from the image computing portion 34 and the scrabble preventing latent image adding control portion 36, and the controller 38 selects one of the signals and supplies the selected signal to the printer engine 39. The printer engine 39 includes the electrophotographic system image forming unit to form the color image on the basis of the CMYK signals transmitted from the controller 38. The image forming unit includes the charging device 21, the exposure device 22, and the development device 1.

In the first embodiment, because the color copying machine is illustrated as the image forming apparatus by way of example, the copying machine main body is provided with the scanner. However, similarly the image formation can be performed in the printer which captures information from a host computer to perform the image formation. In such cases, the scanner 31 is a scanner connected to the host computer, and the image data from the host computer is stored in the image memory 33.

In the color copying machine of the embodiment, the pieces of CMYK image data are transmitted from the scanner 31 to the image memory 33 in the usual duplicate operation in which machine-readable information detection is turned off in the user interface 37. The image computing portion 34 performs pieces of processing such as the enlargement, contraction, and rotation which are instructed by the user or previously set, the image data is transmitted to the printer engine 39 through the controller 38, and the printer engine 39 visualizes and outputs the image data.

On the other hand, when the user specifies the machine-readable information recognition through the user interface 37, the data is fed from the scanner 31 into the image memory 33, the same data as the data transmitted from the image memory 33 to the color image computing portion 34 is transmitted to the machine-readable information determination portion 35. When the machine-readable information determination portion 35 confirms that the transmitted data includes the machine-readable information, the area printed as the machine-readable information is obtained, and the information on the area printed as the machine-readable information is transmitted to the scrabble preventing latent image adding control portion.

When the user instructs machine-readable information confirmation display through the user interface 37, the user is notified of a machine-readable information number through the user interface 37. Then, the data is supplied from the image memory 33 to the color image computing portion 34 by a print instruction from the user, and the data is transmitted from the controller 38 to the printer engine 39, thereby performing the usual color printing.

When the user adds the machine-readable information, the area to which the machine-readable information is added and the machine-readable information number are previously specified by the user interface 37 and registered in the scrabble preventing latent image adding control portion 36. Similarly the data is transmitted from the controller 38 to the printer engine 39 to perform the printing. The controller 38 controls the exposure unit 22 in order to form a predetermined potential difference between the development sleeve and the scrabble preventing latent image part on the image bearing member.

Thus, in forming the machine-readable information such as the barcode and the QR code, the fog removal potential at the non-image part which is adjacent to the machine-readable information and located on the upstream side in the information conveying direction is set smaller than the fog removal potentials at other non-image parts. Therefore, the generation of the missing of the machine-readable information caused by the scrabble phenomenon can be prevented.

Second Embodiment

Figure 10:
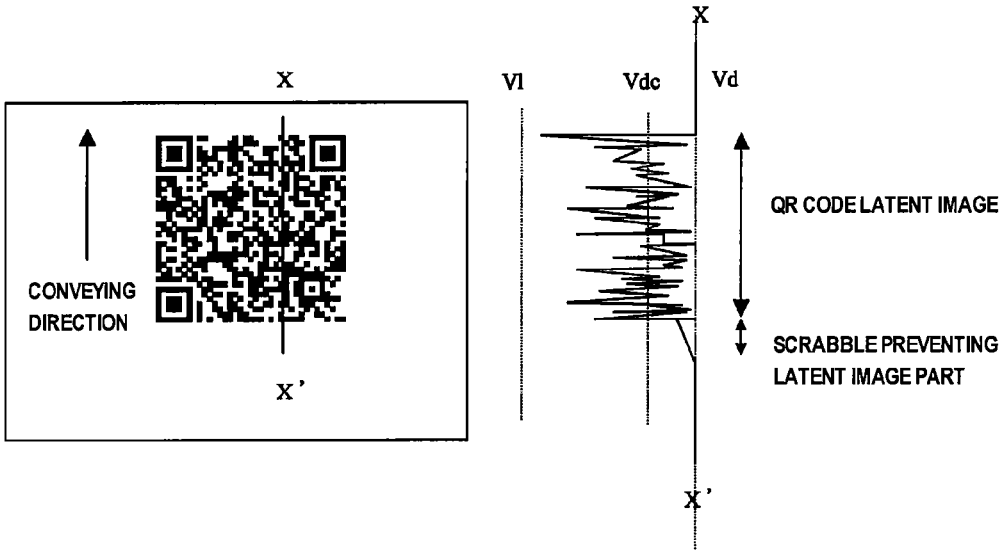
FIG. 10 is an explanatory view illustrating a state of the photosensitive drum potential when the QR code is recorded in a second embodiment of the invention.

An apparatus according to a second embodiment of the invention will be described below with reference to FIG. 10. Because the apparatus of the second embodiment has the same basic configuration as the first embodiment, the overlapped description is neglected and only the configuration different from that of the first embodiment is described below.

In the first embodiment, the scrabble preventing Vback is set smaller than the center potential, and the scrabble preventing Vback is kept constant. In the second embodiment, as illustrated in FIG. 10, the scrabble preventing potential Vback is set so as to be gradually lowered toward the machine-readable information. Therefore, the micro fog area locally generated in the scrabble preventing latent image part can be narrowed.

Accordingly, in the second embodiment, in forming the machine-readable information such as the barcode and the QR code, the image defect and the information missing caused by the scrabble phenomenon are not generated, and the local generation of the micro fog can be suppressed to the minimum.

According to the invention, when the image is developed using the two-component developer, the scrabble phenomenon generated by stripping out the carrier in the non-image part adjacent to the electrostatic image can effectively suppressed to prevent the generation of the image defect of the specific pattern.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-182159, filed Jul. 11, 2007, which is hereby incorporated by reference herein in its entirety.

What is claimed is:

1. An image forming apparatus comprising:

a rotatable image bearing member;

a charging device which charges the image bearing member;

an electrostatic image forming device which forms an electrostatic image by exposing the image bearing member after having the image bearing member charged by the charging device;

a development device which includes a developer bearing member to develop the electrostatic image in a form of a toner image, the developer bearing member bearing a developer containing toner and a magnetic carrier; and a controller which performs a mode in which a potential difference between a first non-image part on the image bearing member and the developer bearing member is smaller than a potential difference between a second non-image part on the image bearing member and the developer bearing member, the first non-image part being adjacent to an electrostatic image having a specific pattern on an upstream side in a rotating direction of the image bearing member.

2. The image forming apparatus according to claim 1, wherein the potential difference between the first non-image part and the developer bearing member is set smaller toward the electrostatic image having the specific pattern.

3. The image forming apparatus according to claim 1, wherein the specific pattern is machine-readable information.

4. The image forming apparatus according to claim 1, further comprising a specific pattern determination portion which determines whether or not the specific pattern is included in the electrostatic image, wherein the controller controls the potential difference between the first non-image part and the developer bearing member based on a determination made by the specific pattern determination portion.

5. The image forming apparatus according to claim 1, wherein the developer bearing member is rotated in a direction opposite the rotating direction of the image bearing member at a circumferential speed faster than a circumferential speed of the image bearing member.

6. The image forming apparatus according to claim 1, wherein the toner image is transferred to a conveyed recording material to form an image, and wherein the second non-image part corresponds to an area of which a recording material is conveyed.

7. An image forming apparatus comprising:

a rotatable image bearing member;

a charging device which charges the image bearing member;

an electrostatic image forming device which foams an electrostatic image by exposing the image bearing member after having the image bearing member charged by the charging device;

a development device which includes a developer bearing member to develop the electrostatic image in a form of a toner image, the developer bearing member bearing a developer containing toner and a magnetic carrier; and a controller which performs a mode in which a potential difference between a non-image part of a predetermined range and the developer bearing member is smaller than a potential difference between other non-image parts and the developer bearing member when an image having a specific pattern is formed, the non-image part of the predetermined range being adjacent to an electrostatic image having the specific pattern on an upstream side in a rotating direction of the image bearing member.

8. The image forming apparatus according to claim 7, wherein the potential difference between the non-image part of the predetermined range and the developer bearing member is, set smaller toward the electrostatic image having the specific pattern.

9. The image forming apparatus according to claim 7, wherein the specific pattern is machine-readable information.

* * * * *